US008125436B2

(12) United States Patent
Wu et al.

(10) Patent No.: US 8,125,436 B2
(45) Date of Patent: Feb. 28, 2012

(54) PIXEL DITHERING DRIVING METHOD AND TIMING CONTROLLER USING THE SAME

(75) Inventors: Tzu-Ming Wu, Taipei County (TW); Kuan-Hung Liu, Taipei Hsien (TW); Yi-Nan Chu, Changhua Hsien (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1003 days.

(21) Appl. No.: 12/060,246

(22) Filed: Mar. 31, 2008

(65) Prior Publication Data

US 2008/0291149 A1 Nov. 27, 2008

(30) Foreign Application Priority Data

May 23, 2007 (TW) ..... 96118350 A

(51) Int. Cl.
*G09G 3/36* (2006.01)

(52) U.S. Cl. ..... 345/98; 345/596

(58) Field of Classification Search ..... 345/98, 345/127, 596; 382/100, 166
See application file for complete search history.

(56) References Cited

U.S. PATENT DOCUMENTS

| | | | | |
|---|---|---|---|---|
| 6,043,802 | A * | 3/2000 | Gormish | 345/596 |
| 6,686,922 | B2 * | 2/2004 | Loce et al. | 345/596 |
| 7,991,186 | B2 * | 8/2011 | Rudaz et al. | 382/100 |
| 2002/0024527 | A1 * | 2/2002 | Kawahara et al. | 345/596 |
| 2003/0030611 | A1 | 2/2003 | Kim et al. | |
| 2003/0202000 | A1 | 10/2003 | Kudo et al. | |
| 2003/0222839 | A1 | 12/2003 | Lee | |
| 2004/0189583 | A1 | 9/2004 | Park et al. | |
| 2005/0162369 | A1 | 7/2005 | Kim et al. | |
| 2005/0195144 | A1 | 9/2005 | Kwon et al. | |
| 2006/0007089 | A1 | 1/2006 | Lee et al. | |
| 2006/0033445 | A1 | 2/2006 | Kim et al. | |

* cited by examiner

*Primary Examiner* — Quan-Zhen Wang
*Assistant Examiner* — Yuk Chow
(74) *Attorney, Agent, or Firm* — Jianq Chyun IP Office

(57) ABSTRACT

A pixel dithering driving method and a timing controller using the same are provided. The method uses the N low order bits of M bits together with at least one virtual bit to build several pixel dithering patterns. After the timing controller uses M bits of data received by the timing controller to look up a specific high order bit value, a specific low order bit value, and a specific pixel dithering value corresponding to the M bits in a predetermined gray level look up table and decides the output gray levels according to the specific high order bit value, the timing controller can further select a specific pixel dithering pattern from the pixel dithering patterns mentioned above according to the specific low order bit value and the specific pixel dithering value.

16 Claims, 8 Drawing Sheets

| 6 bit gray level | | 8 bits data received by the timing controller | | | | | | | | Gray level corresponding to 8 bits |
|---|---|---|---|---|---|---|---|---|---|---|
| | | 6 bits data | | | | | | Low order bits | | |
| 0 | N | 0 | 0 | 0 | 0 | 0 | 0 | 0 | 0 | 0 |
| | | 0 | 0 | 0 | 0 | 0 | 0 | 0 | 1 | 1 |
| | | 0 | 0 | 0 | 0 | 0 | 0 | 1 | 0 | 2 |
| | | 0 | 0 | 0 | 0 | 0 | 0 | 1 | 1 | 3 |
| 1 | N+1 | 0 | 0 | 0 | 0 | 0 | 1 | 0 | 0 | 4 |
| | | 0 | 0 | 0 | 0 | 0 | 1 | 0 | 1 | 5 |
| | | 0 | 0 | 0 | 0 | 0 | 1 | 1 | 0 | 6 |
| | | 0 | 0 | 0 | 0 | 0 | 1 | 1 | 1 | 7 |
| 2 | N+2 | 0 | 0 | 0 | 0 | 1 | 0 | 0 | 0 | 8 |

PIXEL DITHERING DRIVING METHOD AND TIMING CONTROLLER USING THE SAME

CROSS-REFERENCE TO RELATED APPLICATION

This application claims the priority benefit of Taiwan application serial no. 96118350, filed on May 23, 2007. The entirety the above-mentioned patent application is hereby incorporated by reference herein and made a part of specification.

BACKGROUND OF THE INVENTION

1. Field of the Invention

The present invention generally relates to a pixel driving method and a timing controller using the same, and more particularly, to a pixel dithering driving method and a timing controller user the same.

2. Description of Related Art

At present, the integrated circuit and software used of the signal source of a computer or video equipment is capable of generating an increasing number of gray levels, for example, 256 gray levels for an 8-bit resolution or 1024 gray levels for a 10-bit resolution. However, the number of gray levels in the existing visual output apparatus such as display, projector, and printer is often limited by hardware cost consideration to only 64 gray levels, for example. To display the richer original gray levels, simulation techniques including frame rate control (FRC) and dithering are used to enhance the variations of gray levels and increase the number of gray levels.

Frame rate control utilizes the temporary visual retention characteristic of the human eye to cut out more gray levels between two neighboring gray levels by timing control. First, the number of frames displayed per second or the frame rate needs to be increased. According to the desired gray level brightness of the cut out, two close gray levels are displayed base on their ratio. Because of the temporary visual retention characteristic of the human eye, the human eye will react by averaging out the displayed frames seen within this period. Therefore, gray levels not originally displayed by the visual output apparatus can be seen.

FIG. 1 is a simple diagram illustrating the principles behind the frame rate control. First, look at the area on the left side of the arrow in FIG. 1. The dark portion displays identical dark gray levels and the white portion displays identical light gray levels. Next, look at the area from left to right. It can be seen that there is a change of gray level in a frame for every movement of a row to the right (for example, as indicated by 101). When the movement to the right is sufficiently fast, the observed images rapidly accumulate due to the temporary visual retention characteristic of the human eye. As a result, the display as perceived by the human eye is shown in the area on the right side of the arrow. The gray levels in the area increase from top to bottom. Moreover, with more frames changing their gray levels, the number of gray levels also increases. Therefore, using these principles, the display of gray levels in a visual output apparatus is enhanced. For example, for a visual output apparatus that can originally display 64 gray levels, a 6 bits input signal can used to simulate an 8 bits input signal for the gray level.

The operating principles of pixel dithering is very similar to that of the frame rate control because both utilizes the visual averaging of the human eye, the change in several frames are amalgamated together to form differences in gray levels. However, the main difference between the two is that pixel dithering utilizes spatial control to divide more gray levels while the frame rate control utilizes the time control. FIG. 2 is a diagram illustrating the principles of pixel dithering. First, look at the upper portion of FIG. 2. The dark portions in this area display identical dark gray levels and the white portions in this area display identical light gray levels. The lower portion of FIG. 2 displays the average gray levels corresponding to the upper portion, that is, the gray levels in the lower portion are obtained after averaging the gray levels in the upper portion. Through the correspondence between the upper portion and the lower portion of FIG. 2, it should be noted that when more pixels 201 have identical dark gray levels, the corresponding average color is darker. Using this principle, the display of gray level in a visual output apparatus is also enhanced.

At present, the techniques of pixel dithering and frame rate control are combined to produce the so-called 'pixel dithering/frame rate control technique' or simply 'Dithering/FRC'. Using an input gray level signal having 8 bits as an example, the Dithering/FRC technique uses two of the low order bits of the input gray level signals, that is, bit 0 and bit 1, to perform bit processing. The other six high order bits, that is, bit 2~bit 7, are used as basic data. By combining the six high order bits of basic data with the processed result of the two low order bits, a new gray level data is produced as shown in FIG. 3.

FIG. 3 is a diagram illustrating the process of converting 8-bit gray levels to 6-bit gray levels. Because 6 bits can display 0~63 gray levels and 8 bits can display 0~255 gray levels, three gray level variations must be added to every neighboring two gray level variations that can be displayed by 6 bits in order to display 256 gray levels with just 6 bits. FIG. 4 is a look up table between 6-bit gray levels and 8-bit gray levels. For example, three gray level variations are inserted between the $0^{th}$ and the $1^{st}$ gray level variation of the 6 bits. In other words, the low order bits 01, 10 and 11 are respectively used to defined gray level variations and then time difference is used to produce the effect of having 256 levels.

In the following, FIGS. 5A~5D are used to list out the gray level variations as defined by the four low order bits 00, 01, 10 and 11. In FIGS. 5A~5D, each small rectangle in a frame is a pixel and four pixels form a group. According to the description, refer to FIG. 4 and FIGS. 5A~5D when necessary. As shown in FIG. 4, when the last two low order bits of the 8 bits data received by the timing controller (not shown) is 00, the gray levels corresponding to the 8 bits are the 0, 4, 8, . . . levels. Meanwhile, the gray levels corresponding to the 6 bits are the 0, 1, 2, . . . levels, in other words, the $N^{th}$ (represented by N, N+1, N+2 . . . ) level of the 6-bit gray level. At this time, the output gray levels remain unchanged. Therefore, every one of the small rectangles in FIG. 5A is represented by the $N^{th}$ level and has a luminance identical to the luminance displayed by the $N^{th}$ level of the original 6 bit gray level. In other words, the displayed brightness of every frame has a luminance of the $N^{th}$ level.

When the last two low order bits of the 8 bits data received by the timing controller is 01, the gray levels corresponding to the 8 bits are the 1, 5, 9, . . . levels. At this time, the output gray levels need to be slightly changed so as to increase the number of gray levels. The change in output gray levels is shown in FIG. 5B. Frame 1~frame 4 all have one small rectangle represented by the $N+1^{th}$ level and the relative location of the small rectangle displaying the $N+1^{th}$ level are different in different frames so that the spatial display of luminance is an average. Accordingly, each frame in FIG. 5B displays an average luminance of N+(¼)N level.

When the last two low order bits of the 8 bits data received by the timing controller is 10, the gray levels corresponding to the 8 bits are the 2, 6, 10, . . . levels. At this time, the output gray levels also need to be slightly changed so as to increase the number of gray levels. The change in output gray levels is shown in FIG. 5C. Frame 1~frame 4 all have two small rectangle represented by the $N+1^{th}$ level. Furthermore, the two small rectangles displaying the $N+1^{th}$ level are positioned in the upper half, the right half, the lower half and the left half of frame 1~frame 4, respectively. Accordingly, each frame in FIG. 5C displays an average luminance of N+(½)N level.

When the last two low order bits of the 8 bits data received by the timing controller is 11, the gray levels corresponding to the 8 bits are the 3, 7, 11, . . . levels. At this time, the output gray levels also need to be slightly changed so as to increase the number of gray levels. The change in output gray levels is shown in FIG. 5D. Frame 1~frame 4 all have only one small rectangle represented by the $N^{th}$ level and the relative location of the small rectangle displaying the $N^{th}$ level are different in different frames so that the spatial display of luminance is an average. Accordingly, each frame in FIG. 5D displays an average luminance of N+(¾)N level.

On the surface, the Dithering/FRC technique is able to combine spatial and temporal visual effects to display 256 levels through 6 bits. However, in practice, the existing Dithering/FRC technique is incapable of fully displaying all the 256 levels of variations, because it is impossible to insert any more gray level variations after the $63^{rd}$ gray level that is the highest gray level displayed by 6 bits. More specifically, the $252^{nd}$ gray level of 8 bits is capable of being represented by the $63^{rd}$ gray level of 6 bit after the Dithering/FRC algorithm. However, the $253^{rd}$~$255^{th}$ gray levels of the 8 bits are still being represented by the $63^{rd}$ gray level of 6 bit after the Dithering/FRC algorithm. At this time, if gray levels are added, overflow may occur. Therefore, the $252^{nd}$~$255^{th}$ gray levels have identical gray levels so that 6 bits data can generate at most 253 gray level variations.

SUMMARY OF THE INVENTION

Accordingly, the present invention provides a pixel dithering driving method and a timing controller using the same such that 6 bits data can be used to fully display the 256 gray level variations of 8 bits of data.

According to an embodiment of the present invention, a pixel dithering driving method for using M bits to display gray levels that can be displayed by A bits is provided. This method includes the following steps. First, K pixel dithering patterns are defined and then the A bits are divided into M high order bits and N low order bits, wherein A, K, M and N are positive integers greater than 0, and A>M>N>=2, A=M+N, and $2^N<K<=2^{N+1}$. Next, the N low order bits are combined with at least one virtual bit so as to define a pixel dithering value having at least N+1 bits. A corresponding relationship between the pixel dithering values and the aforementioned K pixel dithering patterns is defined, wherein each pixel dithering pattern includes at least K pixels, and the gray level value of each pixel is either L+X or L, wherein L and X are both integers, and $0<=L<=2^M$. The $2^M$ displayed gray levels and the foregoing K pixel dithering patterns are used to display P gray level variations, wherein $2^A<=P<=(2^M-1)\times K+1$. A gray level look up table is provided relating the $2^A$ gray level variations to the P gray level variations. Next, an input gray level signal having A bits are received. The input gray level signal is used to look up a specific high order bit value, a specific low order bit value and a specific pixel dithering value in the gray level look up table. Then, the specific low order bit value and the specific pixel dithering value are used to select a specific pixel dithering pattern from the K pixel dithering patterns, and the specific high order bit value is used to decide the gray level value L.

The present invention also provides a timing controller for using M bits to display gray levels that can be displayed by A bits. The timing controller includes a fabrication and transformation unit and a pixel dithering/frame rate control unit. The fabrication and transformation unit has a predetermined gray level look up table. The fabrication and transformation unit is used to receive an input gray level signal having A bits. Then, the input gray level signal is used to look up a specific high order bit value, a specific low order bit value and a specific pixel dithering value in the gray level look up table. The gray level look up table provides $2^A$ gray level variations to correspond to P gray level variations. The pixel dithering/frame rate control unit has K predetermined pixel dithering patterns. Each pixel dithering pattern includes at least K pixels and the gray level value of each pixel is either L+X or L. This pixel dithering/frame rate control unit is used to decide the gray level value L according to the specific high order value and select a specific pixel dithering pattern from the K pixel dithering patterns according to the specific low order bit value and the specific pixel dithering value. The specific pixel dithering values and the K pixel dithering patterns have a corresponding relationship. Furthermore, A and P are positive integers greater than 0, L and X are positive integers, $2^A<=P<=(2^M-1)\times K+1$, $0<=L<=2^M$, and M and N are the number of high order bits and the number of low order bits of the input gray level signal, respectively.

According to a preferred embodiment of the present invention, if $P=(2^M-1)\times K+1$ and K=6, then each pixel dithering pattern includes 6 frame patterns and each frame pattern includes at least 6 dots. In the 6 dithering patterns: the $3^{rd}$ pixel dithering pattern includes 6 frame patterns, the $1^{st}$ and the $4^{th}$ pixels of the $1^{st}$ frame pattern display the gray level value L+X and the remaining pixels display the gray level value L; the $2^{nd}$ and the $5^{th}$ pixels of the $2^{nd}$ frame pattern display the gray level value L+X and the remaining pixels display the gray level value L; the $3^{rd}$ and $6^{th}$ pixels of the $3^{rd}$ frame pattern display the gray level value L+X and the remaining pixels display the gray level value L; the $4^{th}$ to the $6^{th}$ frame patterns repeat the $1^{st}$ to $3^{rd}$ frame patterns.

The $5^{th}$ pixel dithering pattern includes 6 frame patterns, the $1^{st}$ and the $4^{th}$ pixels of the $1^{st}$ frame pattern display the gray level value L and the remaining pixels display the gray level value L+X; the $2^{nd}$ and the $5^{th}$ pixels of the $2^{nd}$ frame pattern display the gray level value L and the remaining pixels display the gray level value L+X; the $3^{rd}$ and $6^{th}$ pixels of the $3^{rd}$ frame pattern display the gray level value L and the remaining pixels display the gray level value L+X; the $4^{th}$ to the $6^{th}$ frame patterns repeat the $1^{st}$ to $3^{rd}$ frame patterns. The $1^{st}$ pixel dithering pattern includes 6 frame patterns, the pixels of each frame pattern display the gray level value L or the gray level value L+X.

The $2^{nd}$ pixel dithering pattern includes 6 frame patterns, 3 of the frame patterns are identical to the $1^{st}$ to $3^{rd}$ frame patterns of the $3^{rd}$ pixel dithering pattern while all the pixels in the other 3 frame patterns display the gray level value L. The $4^{th}$ pixel dithering pattern includes 6 frame patterns, 3 of the frame patterns are identical to the $1^{st}$ to $3^{rd}$ frame patterns of the $5^{th}$ pixel dithering pattern while the other 3 frame are identical to the $1^{st}$ to $3^{rd}$ frame patterns of the $3^{rd}$ pixel dithering pattern. The $6^{th}$ pixel dithering pattern includes 6 frame patterns, 3 of the frame patterns are identical to the $1^{st}$ to $3^{rd}$ frame patterns of the $5^{th}$ pixel dithering pattern while all the pixels in the other 3 frame patterns display the gray level value L+X. The gray level value L is the specific high order bit value and the value of X is 1.

The present invention uses the two low order bits of 8 bits together with at least one virtual bit to build several pixel dithering patterns. After the timing controller uses 8 bits data received by the timing controller to look up a specific high order bit value, a specific low order bit value, and a specific pixel dithering value corresponding to the 8 bits in a predetermined gray level look up table and decides the output gray levels according to the specific high order bit value, the timing controller can further select a specific pixel dithering pattern from the pixel dithering patterns according to the specific low order bit value and the specific pixel dithering value so as to perform Dithering/FRC. Therefore, the present invention can use 6 bits to fully display 256 gray level variations.

In order to make the aforementioned and other objects, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE EMBODIMENTS

Figure 1:
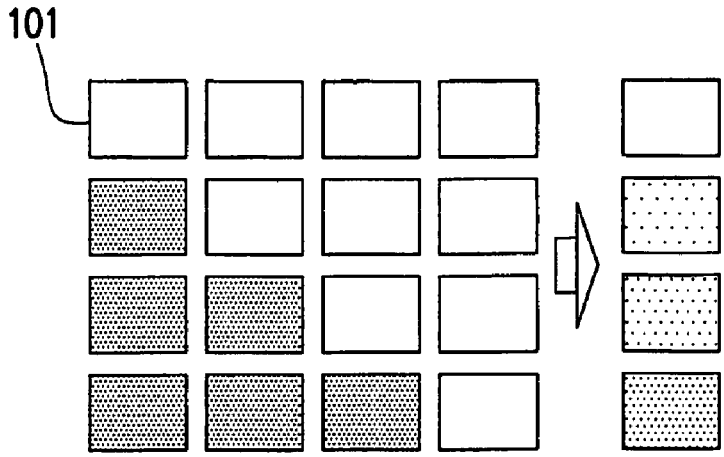
FIG. 1 (PRIOR ART)
FIG. 1 is a simple diagram illustrating the principles behind the frame rate control.
Figure 2:
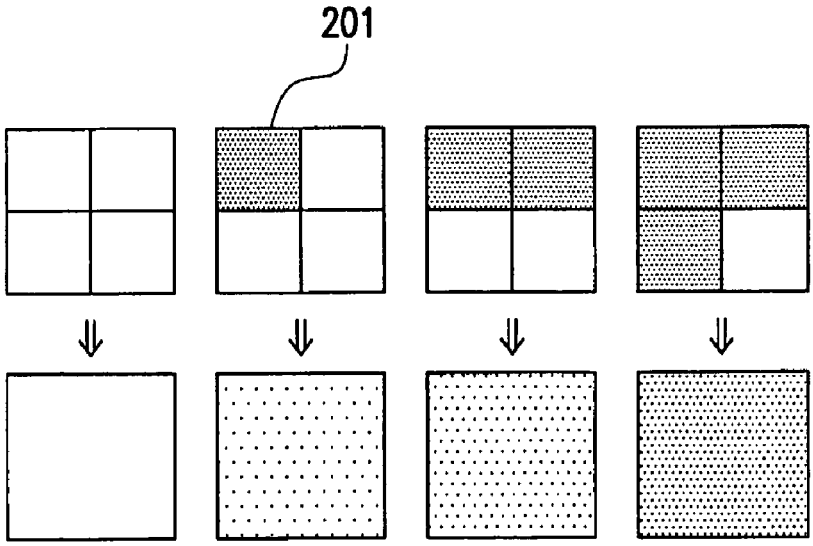
FIG. 2 (PRIOR ART)
FIG. 2 is a diagram illustrating the principles of pixel dithering.
Figures 3, 4:
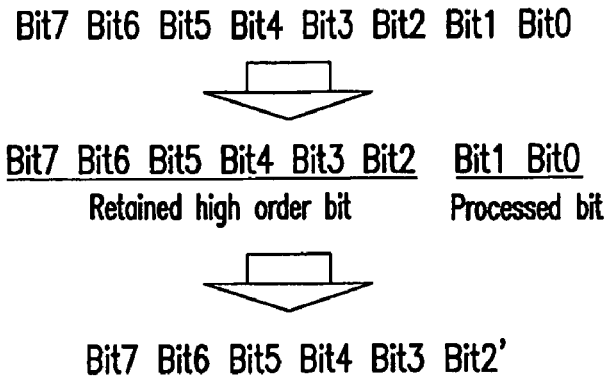
FIG. 3 (PRIOR ART)
FIG. 4 (PRIOR ART)
FIG. 3 is a diagram illustrating the process of converting 8-bit gray levels to 6-bit gray levels.
FIG. 4 is a look up table between 6-bit gray levels and 8-bit gray levels.
Figure 5A:
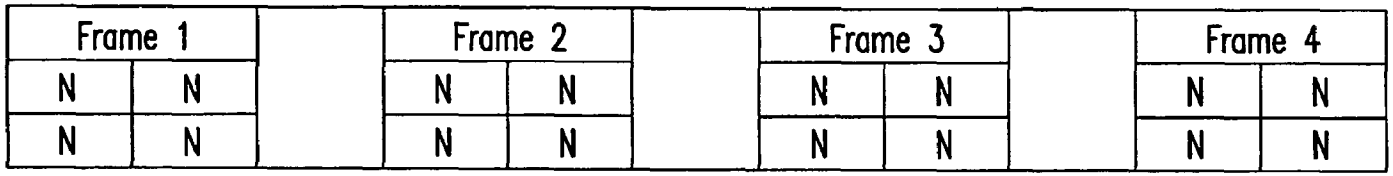
FIG. 5A (PRIOR ART)
FIGS. 5A~5D are diagrams that list out the gray level variations as defined by the four low order bits 00, 01, 10 and 11.
Figure 5B:
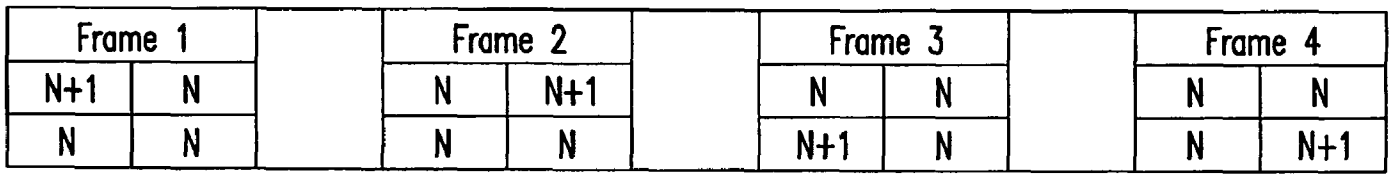
FIG. 5B (PRIOR ART)
Figure 5C:
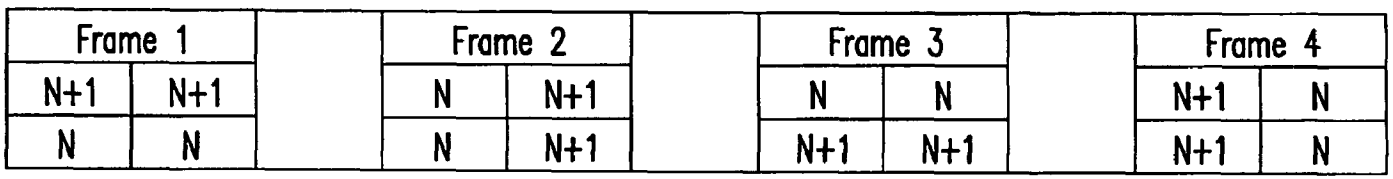
FIG. 5C (PRIOR ART)
Figure 5D:
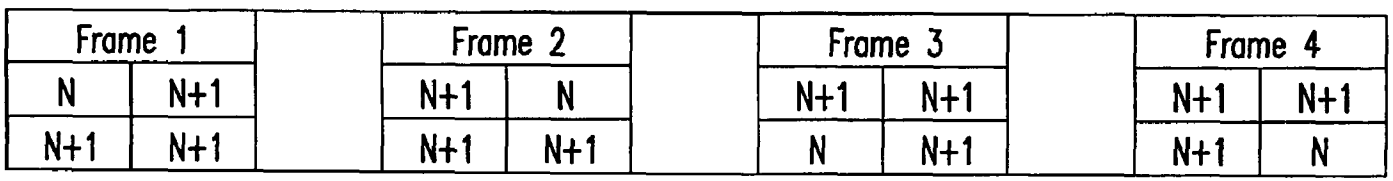
FIG. 5D (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

Figure 6:
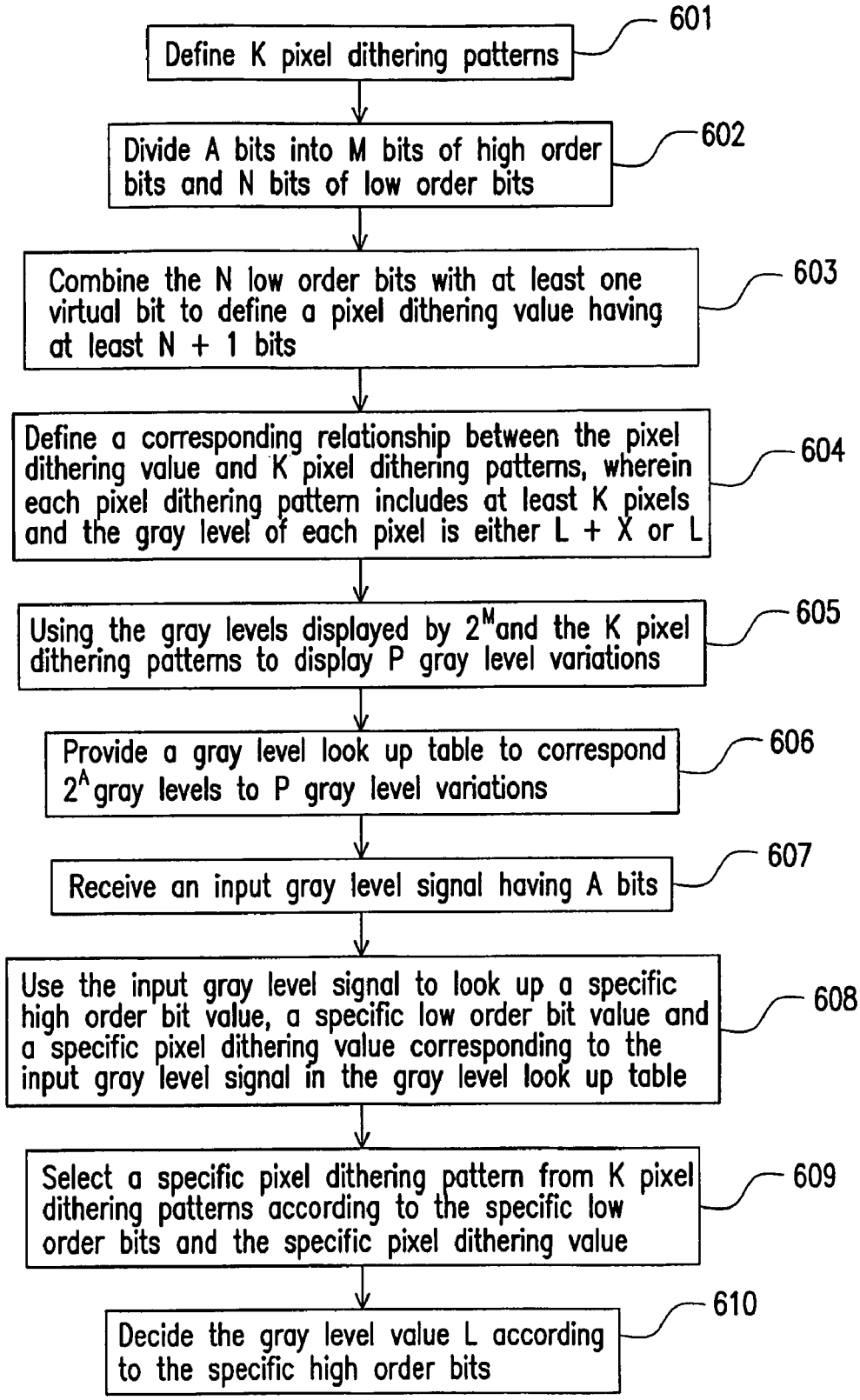
FIG. 6 is a flow diagram showing the steps in a pixel dithering driving method according to a preferred embodiment of the present invention.

To facilitate the description, how 6 (that is, M) bits data can display 256 gray level variations normally displayed only by 8 (that is, A) bits data is used as an example and one may refer to FIG. 6 for details if necessary. FIG. 6 is a flow diagram showing the steps in a pixel dithering driving method according to a preferred embodiment of the present invention.

Because 6 bits data can display at most the gray levels 0~63, K pixel dithering patterns must be defined (as in step 601, the range of K and details of the K pixel dithering patterns are described later on). First, the 8 bits are divided into 6 high order bits and 2 (that is, N) low order bits (as in step 602), for example, 11111100 (the italic numbers represent the high order bits and the remaining numbers represent the low order bits). Next, the two low order bits are combined with at least one virtual bit so as to define a pixel dithering value having at least 3 (that is, N+1) bits (as in step 603). Therefore, the pixel dithering value can have 8 variations (that is, $2^3$).

After defining the pixel dithering value, a relationship between the pixel dithering values and the K pixel dithering patterns can be defined (as in step 604). The gray levels that can be displayed by $2^6$ (that is, $2^M$) bits and the K pixel dithering patterns can cooperate to produce P gray level variations (as in step 605), and the range of P is $2^A<=P<=(2^M-1)\times K+1$ (the actual value of P is described later on). Because the number of bits and the number of patterns cannot be a negative value, the value of A, K, M and N are positive integer greater than 0, and furthermore, A>M>N>=2, A=M+N, and the range of K is $2^N<K<=2^{N+1}$. In other words, at least 5 pixel dithering patterns are required but can have at most 8 pixel dithering patterns.

Since the temporary visual retention characteristic of the human eye cannot hold an image long enough to observe 8 pixel dithering patterns, the number of pixel dithering patterns is adjusted to 6. However, the dithering patterns must include a dithering pattern without changing any gray level (that is, the gray levels that can be displayed by the original 6 bits). Therefore, K is 6 and the actual value of P is 379 (that is, 63×6+1).

Because there are 6 pixel dithering patterns, each pixel dithering pattern must include at least 6 pixels in order to provide sufficient pattern variations. The gray level value of each pixel is either L+X or L, wherein the gray level value L is the specific high order bit value corresponding to the 6 high order bits. Since the range of the gray level value of the 6 bits is between 0~63 (that is, $0<=L<=2^M$), both L and X are positive integers. In this embodiment, X is set to be 1. Next, a gray level look up table is provided. This gray level look up table can correspond the 256 (that is, $2^A$) gray level variations with the 379 (that is, P) gray level variations (as in step 606). The correspondence can be one-to-one, for example, the $23^{rd}$ gray level of the 256 gray levels may correspond with the $23^{rd}$ gray level of the 379 gray levels and the $24^{th}$ gray level of the 256 gray levels may correspond with the $56^{th}$ gray level of the 379 gray level. In general, correspondences are arranged according to the actual requirements of the design.

Figure 7:
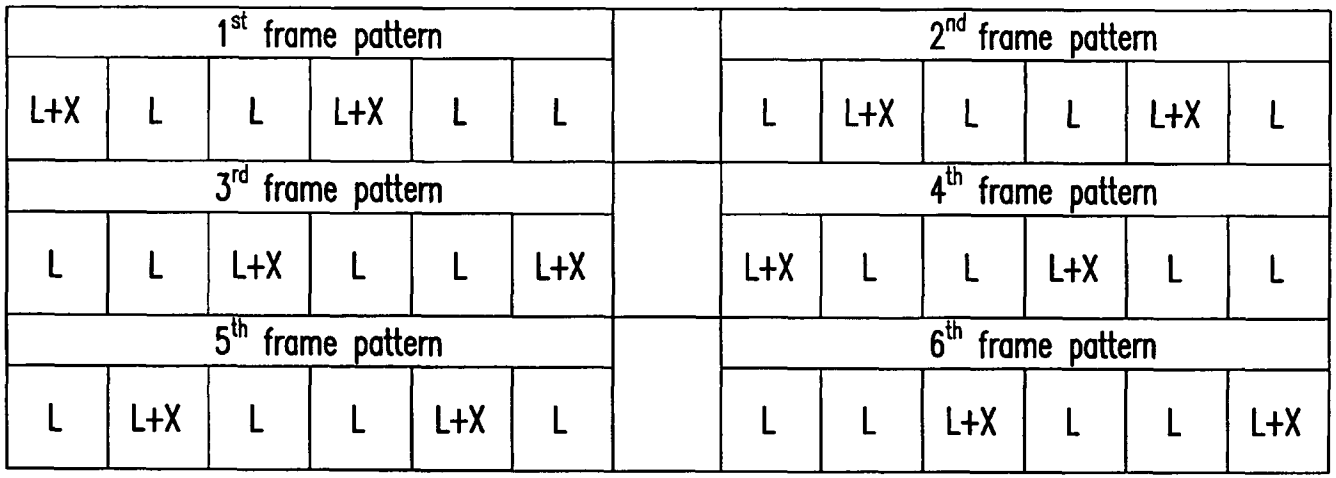
FIG. 7 shows the $3^{rd}$ pixel dithering pattern of 6 pixel dithering patterns in the present invention.

In the following, the 6 pixel dithering patterns are described. FIG. 7 shows the $3^{rd}$ pixel dithering pattern of 6 pixel dithering patterns in the present invention. In other words, FIG. 7 shows the pixel dithering pattern when the pixel dithering value is 2. The $3^{rd}$ pixel dithering pattern includes 6 frame patterns. The $1^{st}$ and the $4^{th}$ pixels in the $1^{st}$ frame pattern display the gray level value L+X while the remaining pixels display the gray level value L. The $2^{nd}$ and the $5^{th}$ pixels in the $2^{nd}$ frame pattern display the gray level value L+X while the remaining pixels display the gray level value L. The $3^{rd}$ and the $6^{th}$ pixels in the $3^{rd}$ frame pattern display the gray level value L+X while the remaining pixels display the gray level value L. The $4^{th}$ $6^{th}$ frame patterns repeat the $1^{st}$~$3^{rd}$ frame patterns. There are two main advantages for repeating the $1^{st}$~$3^{rd}$ frame patterns in the $4^{th}$~$6^{th}$ frame patterns. The first advantage is that the three frame patterns can be used in various combinations to produce other pixel dithering patterns once the $1^{st}$~$3^{rd}$ frame patterns are recorded in memory, a more detailed description is provided subsequently. The second advantage is that the memory required to record the frame patterns is reduced. The $3^{rd}$ pixel dithering pattern is specially designed for the present invention.

Figure 8:
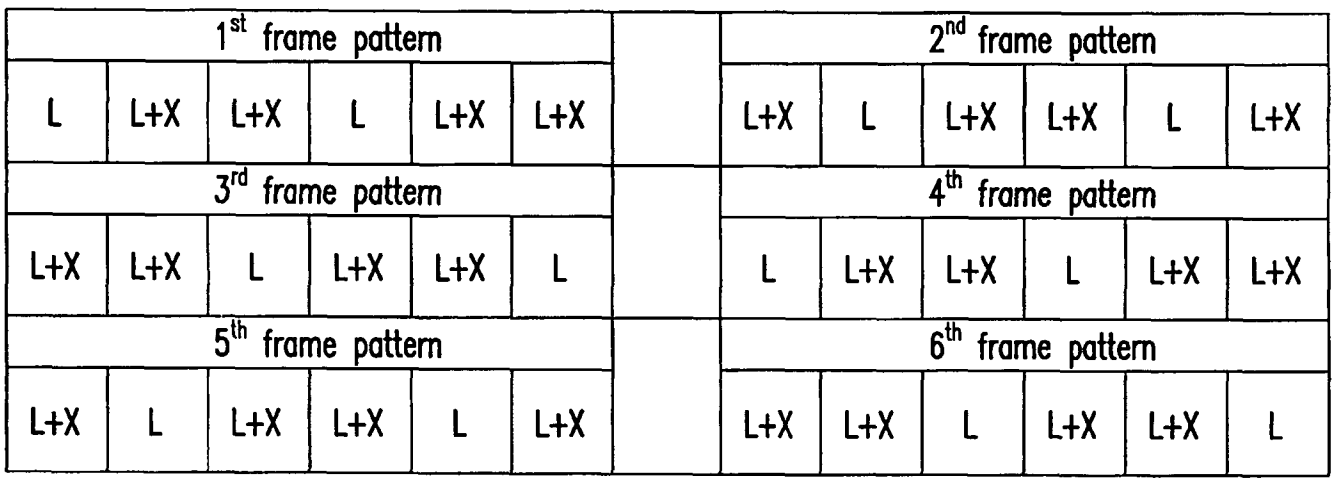
FIG. 8 shows the $5^{th}$ pixel dithering pattern of 6 pixel dithering patterns according to the present invention.

FIG. 8 shows the $5^{th}$ pixel dithering pattern of 6 pixel dithering patterns in the present invention. In other words, FIG. 8 shows the pixel dithering pattern when the pixel dithering value is 4. The $5^{th}$ pixel dithering pattern includes 6 frame patterns. The $1^{st}$ and the $4^{th}$ pixels in the $1^{st}$ frame pattern display the gray level value L while the remaining pixels display the gray level value L+X. The $2^{nd}$ and the $5^{th}$ pixels in the $2^{nd}$ frame pattern display the gray level value L while the remaining pixels display the gray level value L+X. The $3^{rd}$ and the $6^{th}$ pixels in the $3^{rd}$ frame pattern display the gray level value L while the remaining pixels display the gray level value L+X. The $4^{th}$~$6^{th}$ frame patterns repeat the $1^{st}$~$3^{rd}$ frame patterns. More simply, the portions of the $5^{th}$ pixel dithering pattern that display the gray level values L+X is just the opposite of the portions of the $3^{rd}$ pixel dithering pattern that display the gray level values L+X.

Figure 9A:
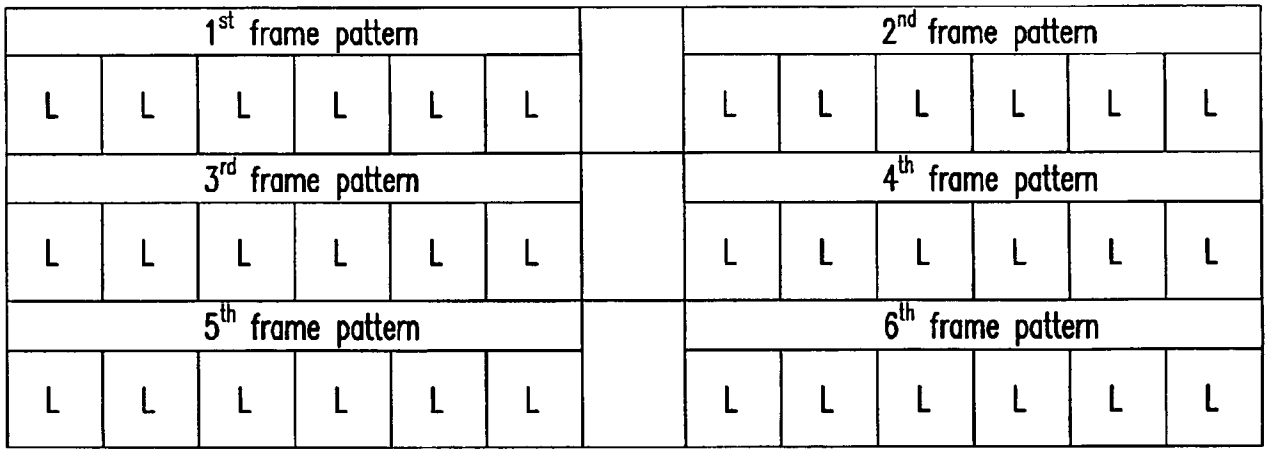
FIGS. 9A and 9B show the $1^{st}$ pixel dithering pattern of 6 pixel dithering patterns according to the present invention.
Figure 9B:
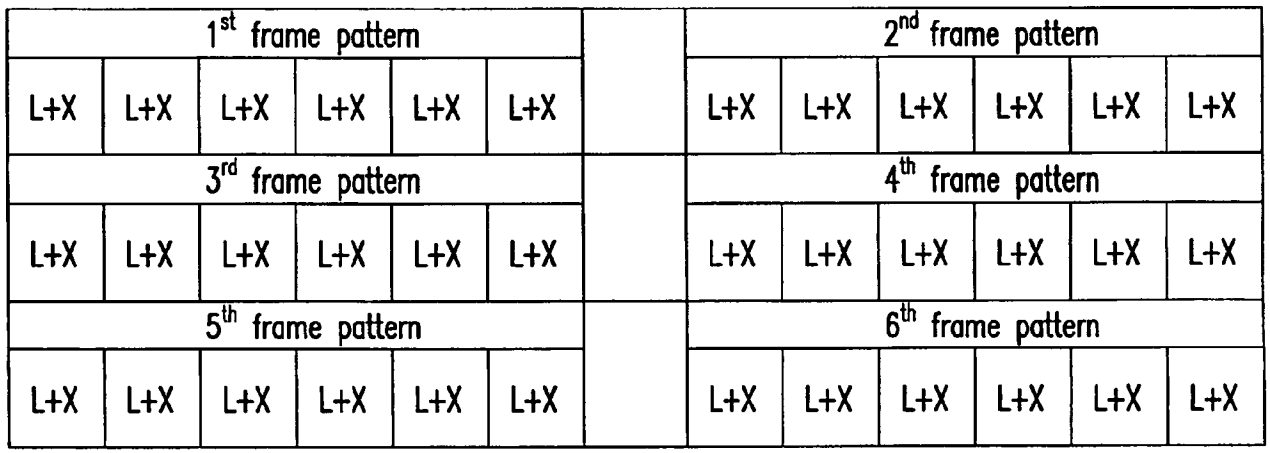

In the following, the 1st pixel dithering pattern, the $2^{nd}$ pixel dithering pattern, the $4^{th}$ pixel dithering pattern and the $6^{th}$ pixel dithering pattern of the 6 pixel dithering patterns are described in sequence. FIGS. 9A and 9B both show the $1^{st}$ pixel dithering pattern. In other words, FIGS. 9A and 9B both show the pixel dithering pattern when the pixel dithering value is 0. The foregoing two diagrams include 6 frame patterns. In FIG. 9A, the pixels of each frame pattern display the gray level value L. In FIG. 9B, the pixels of each frame pattern display the gray level value L+X.

Figure 10:
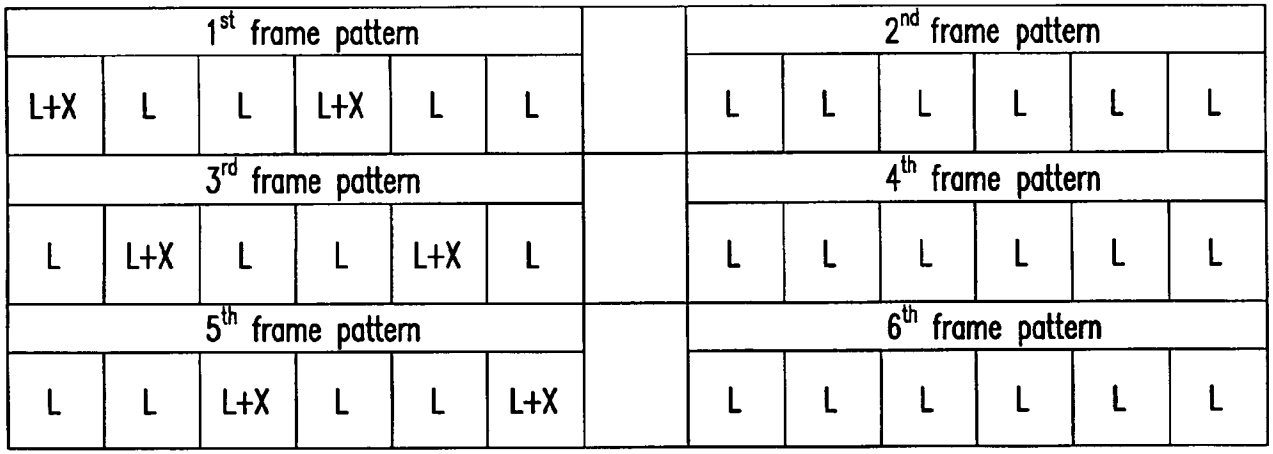
FIG. 10 shows the $2^{nd}$ pixel dithering pattern of 6 pixel dithering patterns according to the present invention.

FIG. 10 shows the $2^{nd}$ pixel dithering pattern of 6 pixel dithering patterns in the present invention. In other words, FIG. 10 shows the pixel dithering pattern when the pixel dithering value is 1. The $2^{nd}$ pixel dithering pattern includes 6 frame patterns. Three of the frame patterns are identical to the $1^{st}$~$3^{rd}$ frame patterns of the $3^{rd}$ pixel dithering pattern while the pixels of the other 3 frame patterns display the gray level value L. In other words, the $2^{nd}$ pixel dithering pattern is produced by combining the $1^{st}$~$3^{rd}$ frame patterns of the $3^{rd}$ pixel dithering pattern and the $1^{st}$ pixel dithering pattern.

Figure 11:
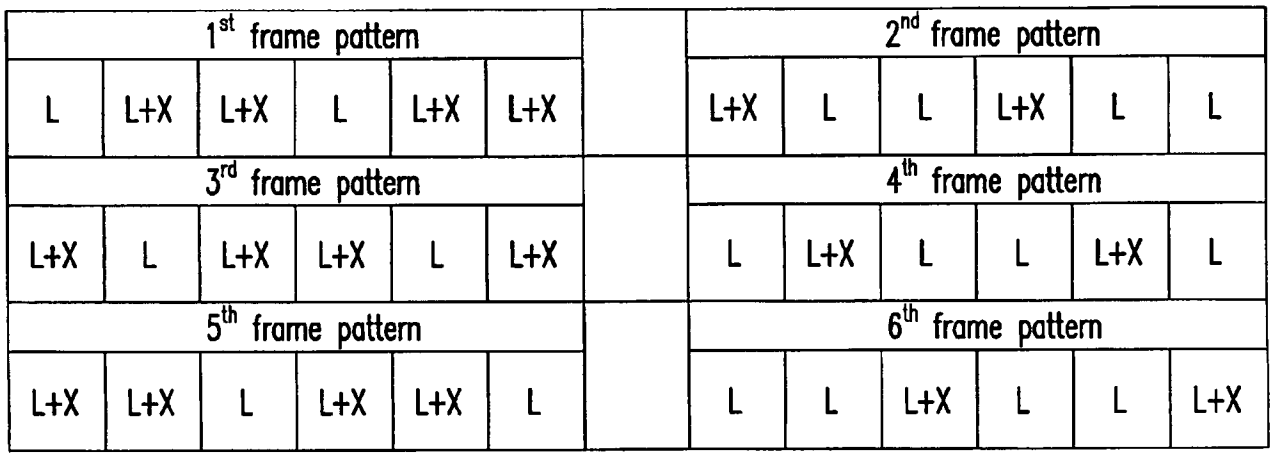
FIG. 11 shows the $4^{th}$ pixel dithering pattern of 6 pixel dithering patterns according to the present invention.

FIG. 11 shows the $4^{th}$ pixel dithering pattern of 6 pixel dithering patterns in the present invention. In other words, FIG. 11 shows the pixel dithering pattern when the pixel dithering value is 3. The $4^{th}$ pixel dithering pattern includes 6 frame patterns. Three of the frame patterns are identical to the $1^{st}$~$3^{rd}$ frame patterns of the $5^{th}$ pixel dithering pattern while the other 3 frame patterns are identical to the $1^{st}$~$3^{rd}$ frame patterns of the $3^{rd}$ pixel dithering pattern. In other words, the $4^{th}$ pixel dithering pattern is produced by combining the $1^{st}$~$3^{rd}$ frame patterns of the $5^{th}$ pixel dithering pattern and the $1^{st}$ 3rd frame patterns of the $3^{rd}$ pixel dithering pattern.

Figure 12:
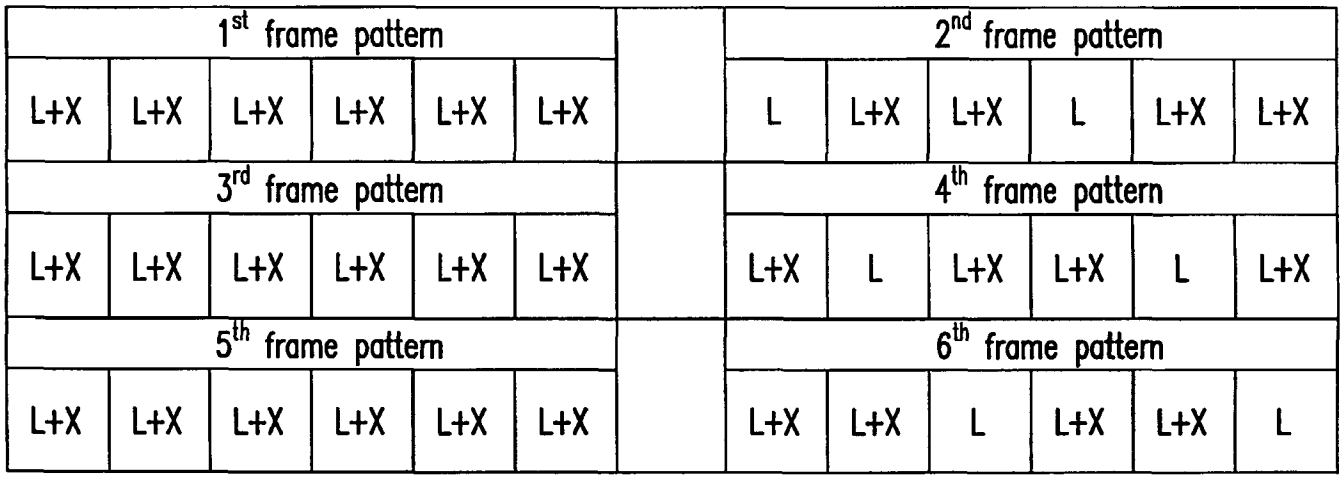
FIG. 12 shows the $6^{th}$ pixel dithering pattern of 6 pixel dithering patterns according to the present invention.

FIG. 12 shows the $6^{th}$ pixel dithering pattern of 6 pixel dithering patterns in the present invention. In other words, FIG. 12 shows the pixel dithering pattern when the pixel dithering value is 5. The $6^{th}$ pixel dithering pattern includes 6 frame patterns. Three of the frame patterns are identical to the $1^{st}$~$3^{rd}$ frame patterns of the $5^{th}$ pixel dithering pattern while the pixels of the other 3 frame patterns display the gray level value L+X. In other words, the $6^{th}$ pixel dithering pattern is produced by combining the $1^{st}$~$3^{rd}$ frame patterns of the $5^{th}$ pixel dithering pattern and the $1^{st}$ pixel dithering pattern. In addition, a rectangle in each frame pattern may represent a pixel or a sub-pixel.

Refer to FIG. 6 again, steps 607~610 are described together with a timing controller. Furthermore, the example of using 6 bits to display 256 gray level variations that can be normally displayed by 8 bits is again used.

Figure 13:
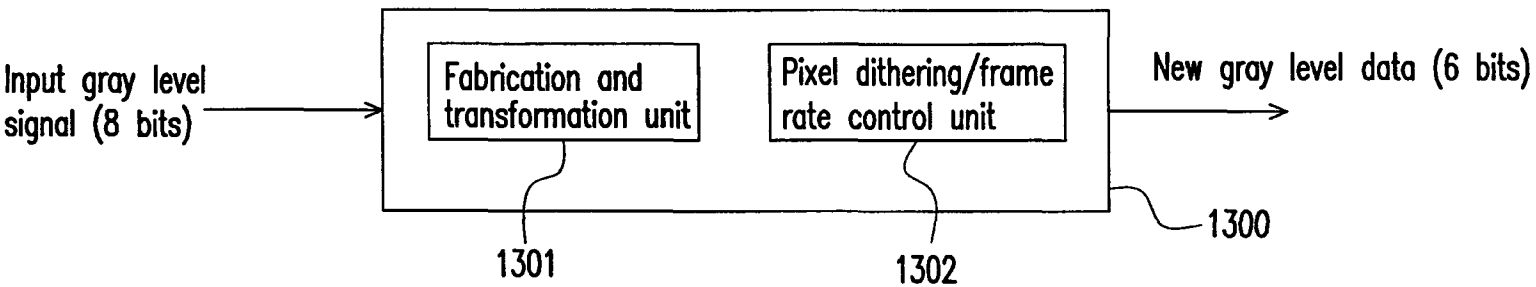
FIG. 13 is a block diagram of a timing controller according to a preferred embodiment of the present invention.

FIG. 13 is a block diagram of a timing controller according to a preferred embodiment of the present invention. The timing controller 1300 includes a fabrication and transformation unit 1301 and a pixel dithering/frame rate control unit 1302. The fabrication and transformation unit 1301 is used for receiving an input gray level signal having 8 bits (as shown in step 607 of FIG. 6). Then, the input gray level signal is used to look up a specific high order bit value, a specific low order bit value and a specific pixel dithering value (as shown in step 608 of FIG. 6) corresponding to the input gray level signal in the built-in gray level look up table (the foregoing gray level look up table). The pixel dithering/frame rate control unit 1302 has predetermined pixel dithering patterns. The pixel dithering/frame rate control unit 1302 selects a specific pixel dithering pattern from the 6 pixel dithering patterns according to the specific low order bit value and the specific pixel dithering value (as shown in step 609 of FIG. 6), and decides the gray level value L of the pixel dithering pattern according to the specific high order bit value (as shown in step 610 of FIG. 6). Finally, the pixel dithering/frame rate control unit 1302 outputs 6 bits data that contains the specific pixel dithering pattern as an new gray level data. Therefore, 6 bits data can fully display the 256 gray level variations normally displayed by 8 bits of data. Alternatively, the pixel dithering/frame rate control unit 1302 may record only the set values of the first three rectangles of the $1^{st}$ frame pattern of the aforementioned $3^{rd}$ pixel dithering pattern, namely, the sequence L+X, L and L, so as to produce the other pixel dithering patterns through some modifications.

It should be noted that the present embodiment has already provided a configuration for implementing the pixel dithering driving method according to the present invention. However, anyone skilled in the art may notice that, as long as the low order bits of an input gray level signal and at least one virtual bit are used to build several pixel dithering patterns and the gray level variations that can be displayed by the high order bits of the input gray level signal together with these pixel dithering patterns are used so as to display gray levels exceeding the original pixels capable of displaying, the spirit of the present invention is satisfied. In addition, the pixel dithering patterns and the number of pixels listed in the present embodiment should not be used to limit the present invention. The user may provide suitable modifications according to the actual requirements. For example, under the same conditions as the foregoing embodiment, the number of pixels in each pixel dithering pattern can be changed to a multiple of 6 such as 12 pixels in order to display 6 variations.

In summary, the present invention uses the two low order bits of 8 bits together with at least one virtual bit to build several pixel dithering patterns. After the timing controller uses 8 bits data received by the timing controller to look up a specific high order bit value, a specific low order bit value, and a specific pixel dithering value corresponding to the 8 bits in a predetermined gray level look up table and decides the output gray levels according to the specific high order bit value, the timing controller can further select a specific pixel dithering pattern from the pixel dithering patterns according to the specific low order bit value and the specific pixel dithering value so as to perform Dithering/FRC. Therefore, the present invention can use 6 bits to fully display 256 gray level variations.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel dithering driving method for using M bits to display gray levels that can be displayed by A bits, comprising:

defining K pixel dithering patterns;

dividing A bits into M high order bits and N low order bits, wherein A, K, M, N are positive integer greater than 0, and A>M>N>=2, A=M+N, and $2^N<K<=2^{N+1}$;

combining the N low order bits with at least one virtual bit to define a pixel dithering value having at least N+1 bits;

defining a corresponding relationship between the pixel dithering value and the K pixel dithering patterns, wherein each pixel dithering pattern comprises at least K pixels, the gray level value of each pixel is either L+X or L, wherein both L and X are positive integers, and $0<=L<=2^M$;

using the gray levels displayed by $2^M$ and the K pixel dithering patterns to display P gray level variations, wherein $2^A<=P<=(2^M-1)\times K+1$;

providing a gray level look up table to correspond the $2^A$ gray level variations with P gray level variations;

receiving an input gray level signal having A bits;

using the input gray level signal to look up a specific high order bit value, a specific low order bit value and a specific pixel dithering value corresponding to the input gray level signal in the gray level look up table;

selecting a specific pixel dithering pattern from the K pixel dithering patterns by using the specific low order bit value and the specific pixel dithering value; and deciding the gray level value L by using the specific high order bit value.

2. The pixel dithering driving method according to claim 1, wherein $P=(2^M-1)\times K+1$.

3. The pixel dithering driving method according to claim 1, wherein each pixel dithering pattern comprises K frame patterns.

4. The pixel dithering driving method according to claim 3, wherein K is equal to 6 and each frame pattern comprises at least 6 pixels.

5. The pixel dithering driving method according to claim 4, wherein:

a $3^{rd}$ pixel dithering pattern comprises 6 frame patterns, a $1^{st}$ and a $4^{th}$ pixel of a $1^{st}$ frame pattern thereof display a gray level value L+X while the remaining pixels display a gray level value L, a $2^{nd}$ and a $5^{th}$ pixel of a $2^{nd}$ frame pattern thereof display the gray level value L+X while the remaining pixels display the gray level value L, a $3^{rd}$ and a $6^{th}$ pixel of a $3^{rd}$ frame pattern thereof display the gray level value L+X while the remaining pixels display the gray level value L, $4^{th}$~$6^{th}$ frame patterns thereof repeat the $1^{st}$~$3^{rd}$ frame patterns;

a $5^{th}$ pixel dithering pattern comprises 6 frame patterns, a $1^{st}$ and a $4^{th}$ pixel of a $1^{st}$ frame pattern thereof display a gray level value L while the remaining pixels display a gray level value L+X, a $2^{nd}$ and a $5^{th}$ pixel of a $2^{nd}$ frame pattern thereof display the gray level value L while the remaining pixels display the gray level value L +X, a $3^{rd}$ and a $6^{th}$ pixel of a $3^{rd}$ frame pattern thereof display the gray level value L while the remaining pixels display the gray level value L+X, $4^{th}$~$6^{th}$ frame patterns thereof repeat the $1^{st}$~$3^{rd}$ frame patterns; and a $1^{st}$ pixel dithering pattern comprises 6 frame patterns, the pixels in each frame pattern display either the gray level value L or the gray level value L+X.

6. The pixel dithering driving method according to claim 5, wherein:

a $2^{nd}$ pixel dithering pattern comprises 6 frame patterns, 3 of the frame patterns thereof are identical to the $1^{st}$~$3^{rd}$ frame patterns of the $3^{rd}$ pixel dithering pattern while all the pixels in the other 3 frame patterns display the gray level value L;

a $4^{th}$ pixel dithering pattern comprises 6 frame patterns, 3 of the frame patterns thereof are identical to the $1^{st}$~$3^{rd}$ frame patterns of the $5^{th}$ pixel dithering pattern while the other 3 frame patterns are identical to the $1^{st}$~$3^{rd}$ frame patterns of the $3^{rd}$ pixel dithering pattern; and a $6^{th}$ pixel dithering pattern comprises 6 frame patterns, 3 of the frame patterns thereof are identical to the $1^{st}$~$3^{rd}$ frame patterns of the $5^{th}$ pixel dithering pattern while all the pixels in the other 3 frame patterns display the gray level value L+X.

7. The pixel dithering driving method according to claim 1, wherein the gray level value L is the specific high order bit value and X is equal to 1.

8. The pixel dithering driving method according to claim 7, wherein M=6, A=8, and N=2.

9. A timing controller for using M bits to display gray levels that can be displayed by A bits, comprising:

a fabrication and transformation unit having a predetermined gray level look up table and used for receiving an input gray level signal having A bits and using the input gray level signal to look up a specific high order bit value, a specific low order bit value and a specific pixel dithering value corresponding to the input gray level signal in the gray level look up table, wherein the gray level look up table provides $2^A$ gray level variations to correspond to P gray level variations; and a pixel dithering/frame rate control unit, having K predetermined pixel dithering patterns with each pixel dithering pattern comprising at least K pixels and the gray level value of each pixel being either L+X or L, wherein the pixel dithering/frame rate control unit is used for deciding the gray level value L according to the specific high order level bit value, and selecting a specific pixel dithering pattern from the K pixel dithering patterns according to the specific low order bit value and the specific pixel dithering value, wherein the specific pixel dithering value and the K pixel dithering patterns have a corresponding relationship, and both A, P are positive integers greater than 0, L and X are positive integers, $2^A<=P<=(2^M-1)\times K+1$, $0<=L<=2^M$; M and N are the number of high order bits and the number of low order bits in the input gray level signal, respectively.

10. The timing controller according to claim 9, wherein $P=(2^M-1)\times K+1$.

11. The timing controller according to claim 9, wherein each pixel dithering pattern comprises K frame patterns.

12. The timing controller according to claim 11, wherein K is equal to 6 and each frame pattern comprises at least 6 pixels.

13. The timing controller according to claim 12, wherein:

a $3^{rd}$ pixel dithering pattern comprises 6 frame patterns, a $1^{st}$ and a $4^{th}$ pixel of a $1^{st}$ frame pattern thereof display a gray level value L+X while the remaining pixels display a gray level value L, a $2^{nd}$ and a $5^{th}$ pixel of a $2^{nd}$ frame pattern thereof display the gray level value L+X while the remaining pixels display the gray level value L, a $3^{rd}$ and a $6^{th}$ pixel of a $3^{rd}$ frame pattern thereof display the gray level value L+X while the remaining pixels display the gray level value L, $4^{th}$~$6^{th}$ frame patterns thereof repeat the $1^{st}$~$3^{rd}$ frame patterns;

a $5^{th}$ pixel dithering pattern comprises 6 frame patterns, a $1^{st}$ and a $4^{th}$ pixel of a $1^{st}$ frame pattern thereof display a gray level value L while the remaining pixels display a gray level value L+X, a $2^{nd}$ and a $5^{th}$ pixel of a $2^{nd}$ frame pattern thereof display the gray level value L while the remaining pixels display the gray level value L +X, a $3^{rd}$ and a $6^{th}$ pixel of a $3^{rd}$ frame pattern thereof display the gray level value L while the remaining pixels display the gray level value L+X, $4^{th}$~$6^{th}$ frame patterns thereof repeat the $1^{st}$~$3^{rd}$ frame patterns; and a $1^{st}$ pixel dithering pattern comprises 6 frame patterns, the pixels in each frame pattern display either the gray level value L or the gray level value L+X.

14. The timing controller according to claim 13, wherein:

a $2^{nd}$ pixel dithering pattern comprises 6 frame patterns, 3 of the frame patterns thereof are identical to the $1^{st}$~$3^{rd}$ frame patterns of the $3^{rd}$ pixel dithering pattern while all the pixels in the other 3 frame patterns display the gray level value L;

a $4^{th}$ pixel dithering pattern comprises 6 frame patterns, 3 of the frame patterns thereof are identical to the $1^{st}$~$3^{rd}$ frame patterns of the $5^{th}$ pixel dithering pattern while the other 3 frame patterns are identical to the $1^{st}$~$3^{rd}$ frame patterns of the $3^{rd}$ pixel dithering pattern; and a $6^{th}$ pixel dithering pattern comprises 6 frame patterns, 3 of the frame patterns thereof are identical to the $1^{st}$~$3^{rd}$ frame patterns of the $5^{th}$ pixel dithering pattern while all the pixels in the other 3 frame patterns display the gray level value L+X.

15. The timing controller according to claim 9, wherein the gray level value L is the specific high order bit value and X is equal to 1.

16. The timing controller according to claim 15, wherein M=6, A=8, and N=2.

* * * * *